United States Patent [19]

Hammer

[11] 4,082,184

[45] Apr. 4, 1978

[54] NONLOCKING NESTABLE CONTAINER

[76] Inventor: Gregory Wilton Hammer, R.R. No. 1, Hamler, Ohio 43524

[21] Appl. No.: 761,863

[22] Filed: Jan. 24, 1977

[51] Int. Cl.[2] ..... B65D 21/02

[52] U.S. Cl. ..... 206/519; 206/520

[58] Field of Search ..... 206/515, 519, 520

[56] References Cited

U.S. PATENT DOCUMENTS

| | | | |
|---|---|---|---|
| 2,602,568 | 7/1952 | Kimney | 206/519 |
| 2,859,557 | 11/1958 | Lattuca | 206/515 |
| 3,009,603 | 11/1961 | Stockdale | 206/519 |
| 3,091,360 | 5/1963 | Edwards | 206/520 |
| 3,123,273 | 3/1964 | Miller | 206/520 |
| 3,831,745 | 8/1974 | Rump | 206/520 |

*Primary Examiner*—George E. Lowrance

*Attorney, Agent, or Firm*—W. Preston Hickey

[57] ABSTRACT

Nonlocking plastic containers having shoulders that are spaced uniformly along the outside of a container for abutment with a plurality of shoulders on the inside of another one of the containers into which it is nested. The shoulders divide the container into a plurality of segments of uniform height and these segments are preferably tapered by an angle that is no greater than will cause the outside diameter of an outside shoulder at the bottom of a segment to be greater than the inside diameter of the inside shoulder at the top of a segment. The shoulders may be rounded in which case at least three abutments are provided to insure that the inside and outside rounded shoulders of nested containers will stay opposite each other.

5 Claims, 5 Drawing Figures

NONLOCKING NESTABLE CONTAINER

BACKGROUND OF THE INVENTION

The present invention relates to nonlocking, nestable containers, and more particularly to nonlocking, plastic, nestable containers for soft bruisable farm commodities, such as tomatoes, peaches, pears, etc..

Presently, soft bruisable fruits are placed in wooden baskets when they are picked, and the baskets are loaded into wagons, where the baskets are stacked on top of each other, and the wagons are hauled to the processing plant. The containers with which we are concerned may have various height to diameter ratios; but because of the necessity of stacking the baskets, the proportion with which we are most particularly concerned is one wherein the height slightly exceeds the diameter, and such containers are conventionally called hampers. Hampers usually have tapered sides so that the bottoms are approximately one half of the diameter of the top. When a first layer of these hampers are arranged tightly together in staggered rows, another layer of hampers can be placed on top by resting the bottoms of the hampers of the top layer across the edges of three adjacent hampers of the bottom layer. Because the bottom of the hampers is only about half as large as the top, the bottoms will set upon the tops without crushing fruit projecting out of the top of the bottom layer of hampers.

A large number of hampers, bushel baskets, and similar type containers, are used on farms for harvesting crops; and it is a necessary requirement that these containers nest into each other in order that they can be stored and transported economically. One of the problems which occurs with such containers is that they become locked when they are nested; and they sometimes have to be pried apart. Containers that become locked together may cause delays in dropping individual containers off of wagons at spaced locations, so that the equipment has to be stopped and started. Such delays are annoying, costly, and produce unnecessary wear and tear on the equipment.

An object of the present invention is the provision of a new and improved container which is nestable and is nonlocking.

Another object of the present invention is the provision of a new and improved container of the above described type which can be made of a flexible plastic and still not bulge appreciably under heavy loads.

A further object of the invention is the provision of a new and improved container of the above described type which does not contain sharp edges which will damage the fruit.

Further objects and advantages of the invention will become apparent to those skilled in the art to which the invention relates from the following description of several preferred embodiments which are described with reference to the accompanying drawings.

DESCRIPTION OF THE PREFERRED EMBODIMENTS

According to the principles of the present invention, a container is provided with sidewalls that are formed by a plurality of concentric segments, which are stepped inwardly in consecutive order proceeding from top to bottom. The segments are of uniform height, and the steps form inner and outer shoulders, with the inner shoulders facing toward the top open end of the container, and the outer shoulders facing toward the bottom of the container. The diameter of the bottom outside edge of each segment is greater than the top inside edge of each segment. With this arrangement, it is possible for the outside shoulders of one container to seat against the inside shoulders of another container when the containers are nested. By providing shoulders, or seats, that are distributed at spaced apart locations from top to bottom of the sidewalls, it is possible to separate nested containers even though a mismatch between the nested containers should occur due to expansion of one, contraction of the other, or both. Where the shoulders are provided with square edges, one shoulder will seat directly on top of another. Where the shoulders are rounded, however, the rounded outside shoulders may abut the rounded inside shoulders. Surprisingly, such containers can be easily separated, however, by rolling the nested containers. The rounded shoulders provide an upward component, and because the shoulders are spaced along substantially the full height of the sidewalls, the top one of the nested containers rolls out of its surrounding container. Likewise, the bottom one of nested containers can be rolled off of its inside container. Part of the reason for this may be the fact that a seat between two end containers of a nested group of containers will fall outside of the adjacent end of a third of the group of nested containers. Another reason may be that when nested containers are pushed down upon a flat surface, the top side and bottom side become more firmly wedged together while the opposite sides are loosened. By rolling the nested containers, the loosened portions are caused to more circumferentially around the nested containers to accomplish a readjustment and a releasing of the nested containers.

Figure 1:
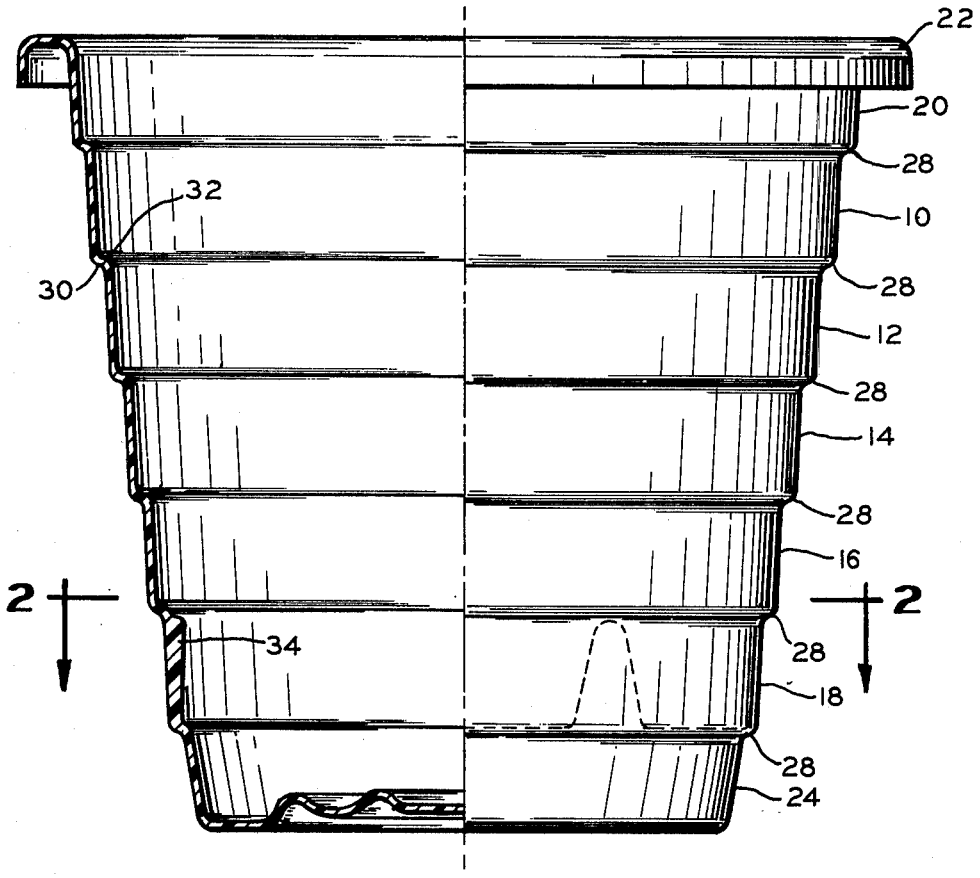
FIG. 1 is a side elevational view of a preferred embodiment of the invention, and which is partly in section to better show the construction.

The embodiment of container shown in FIG. 1 comprises a plurality of concentric generally cylindrical segments 10, 12, 14, 16, and 18 which are of identical height, but which are of progressively smaller diameter proceeding from top to bottom. The container also includes a top segment 20 of slightly larger diameter than the segment 10 with the upper side edges of the top section being rounded outwardly and then downwardly in a U-shape to provide a circumferentially extending finger tip receiving handle 22. The container also includes a bottom segment 24 which joins the bottom 26 of the container with the bottom of the lower most uniform segment 18. All of the segments previously referred to are joined by identically shaped steps or shoulders 28, each of which provide an outwardly and downwardly facing seat 30 and an inwardly and upwardly facing seat 32. In some instances, the outside and inside seats 30 and 32 respectively, may be square to provide flat seats; but in the embodiment shown in FIG. 1, the steps 28 are formed by reverse curvatures which are tangent to each other and to the adjacent segments. The sections of reverse curvature have the same thickness as do all of the segments. In some instances, the segments may have straight or cylindrical sides, but in the embodiment shown, they are slightly conical to provide a taper which permits the containers to be easily extracted from the mold in which they are formed. As previously stated, it is a provision of the present invention, however, that the taper will not be greater than will permit the outside edge of the downwardly facing seat 30 to be less than the inside edge of the upwardly facing seat 32. This requires the taper to be less than the thickness of the material in the segments 10 through 24. Parts of the above described configuration can be easily molded and removed from the mold. Some plastics may contract slightly from the shape of the mold in which they are made during cooling to room temperature, while others may expand slightly from the mold configuration when they cool to room temperature. Containers made from the same mold and of the same plastic will normally nest together with the outside shoulders 30 in abutment with the inside shoulders 32. It will be seen that the steps 28 not only provide nesting seats, but form stiffening rings to oppose bulging of the sides of the plastic containers under load. Because there are a plurality of seats, there will be a plurality, and in this case, six of nested containers which will be opposing each other, so that all of the axial force on nested containers will not be delivered to a single seat and thereby cause it to be wedged or expanded outwardly. It is, therefore, practically impossible for the segments of one container to become jammed down inside of a smaller segment of a surrounding container to thereby become locked together. It may sometimes happen, however, that containers may be made from the same mold, but plastics of different shrinkage characteristics, or that the nested containers may have come from molds of slightly different diameters.

According to another feature of the present invention, additional abutments may be provided, without upsetting the basic configuration, which will assure that the outside seats 30 of an inside container will remain jutaposed to the inside seats 32 of an outside container even though they may be of nonmatching diameters. In the embodiments shown in FIGS. 1, 2, and 3, this is accomplished by generally triangularly shaped abutments 34, of which there are preferably at least three, and which extend upwardly on the inside of the container from one seat 32 to just beneath or adjacent to the point of tangency of the seat 32 that is adjacent the top of the same segment. It will be seen that the top of the abutments 34 are engaged by the rounded portions of the seats 30 of nesting containers, so that relative flexing action previously described will loosen the containers. The inside surfaces of the abutments 34 can be slightly tapered, but can also be substantially verticle and still be easily extracted from a mold by reason of the fact that the abutments 34 have such a small surface. The abutments 34 may be variously located, as for example each may be located in separate segments; but in the preferred embodiment shown in FIGS. 1 through 3 they are all located in the lower most uniform segment 18 of the container. This has the advantage that any bearing action on the abutments 34 is transmitted directly to the bottom segment 24. It will further be seen that the bottom segment 24 has a slightly greater taper than do the segments 10 through 20, and this permits the bottom to be of a smaller diameter which will just seat upon the top edges of a bottom layer of containers. FIG. 3 of the drawings shows two of the containers previously described in a nested condition wherein the seating load is distributed over five points along the full height of the outer container.

Figure 2:
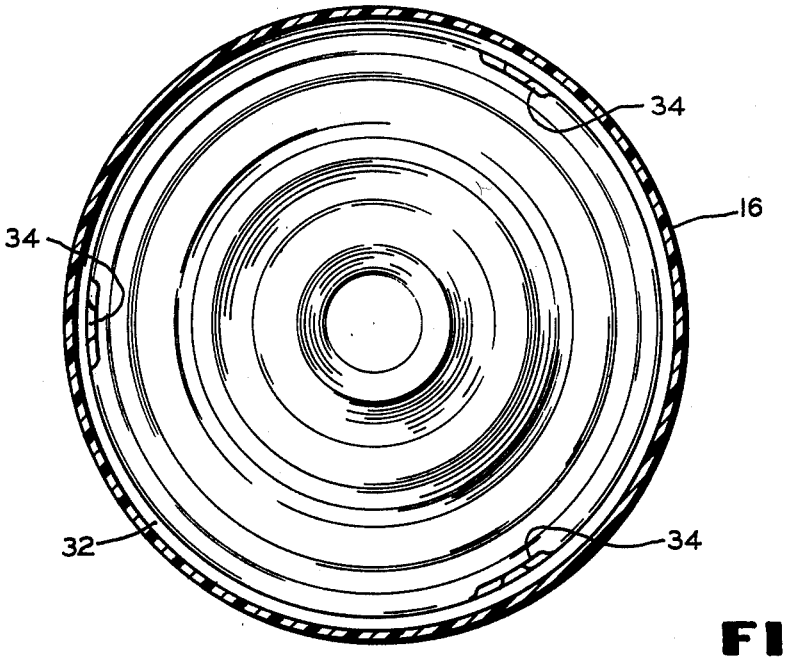
FIG. 2 is a sectional view taken approximately on the line 2—2 of FIG. 1.
Figure 3:
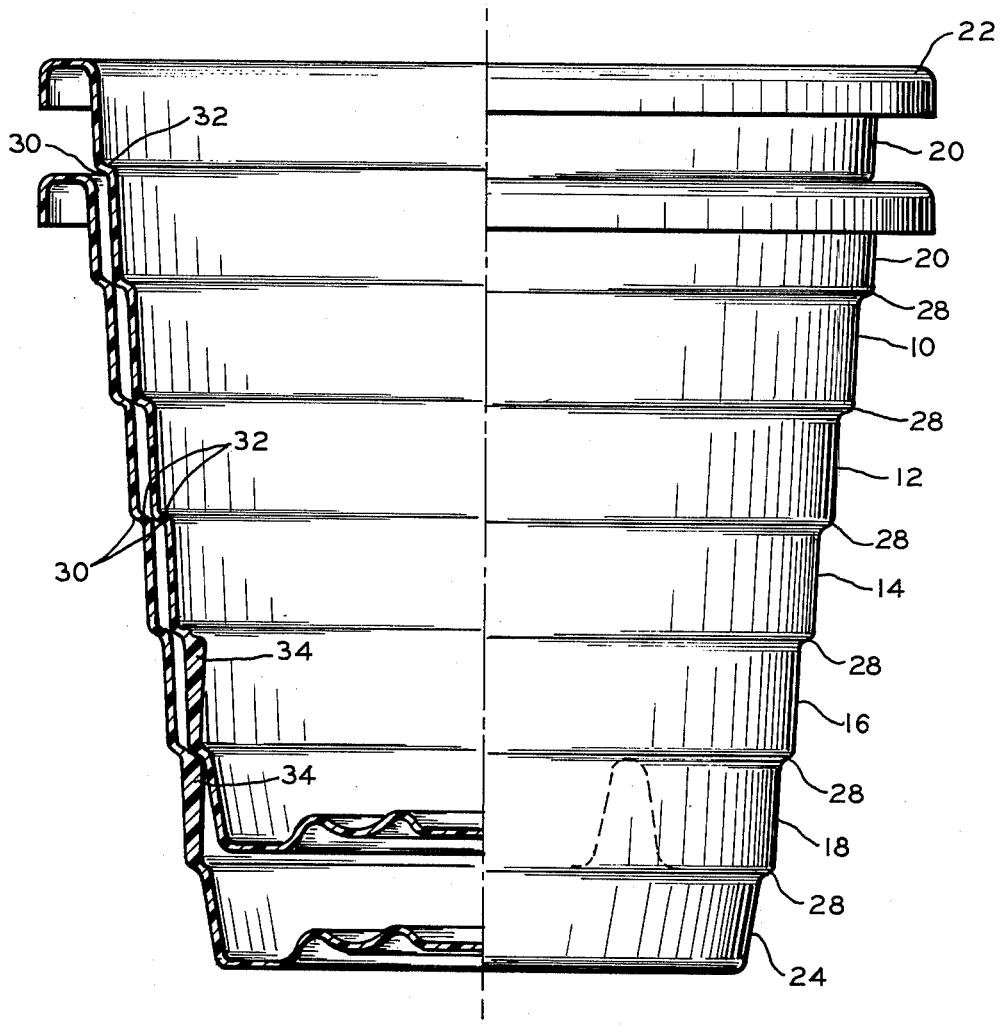
FIG. 3 is an elevational view, partly in section, and showing two of the containers shown in FIGS. 1 and 2 nested together.
Figure 4:
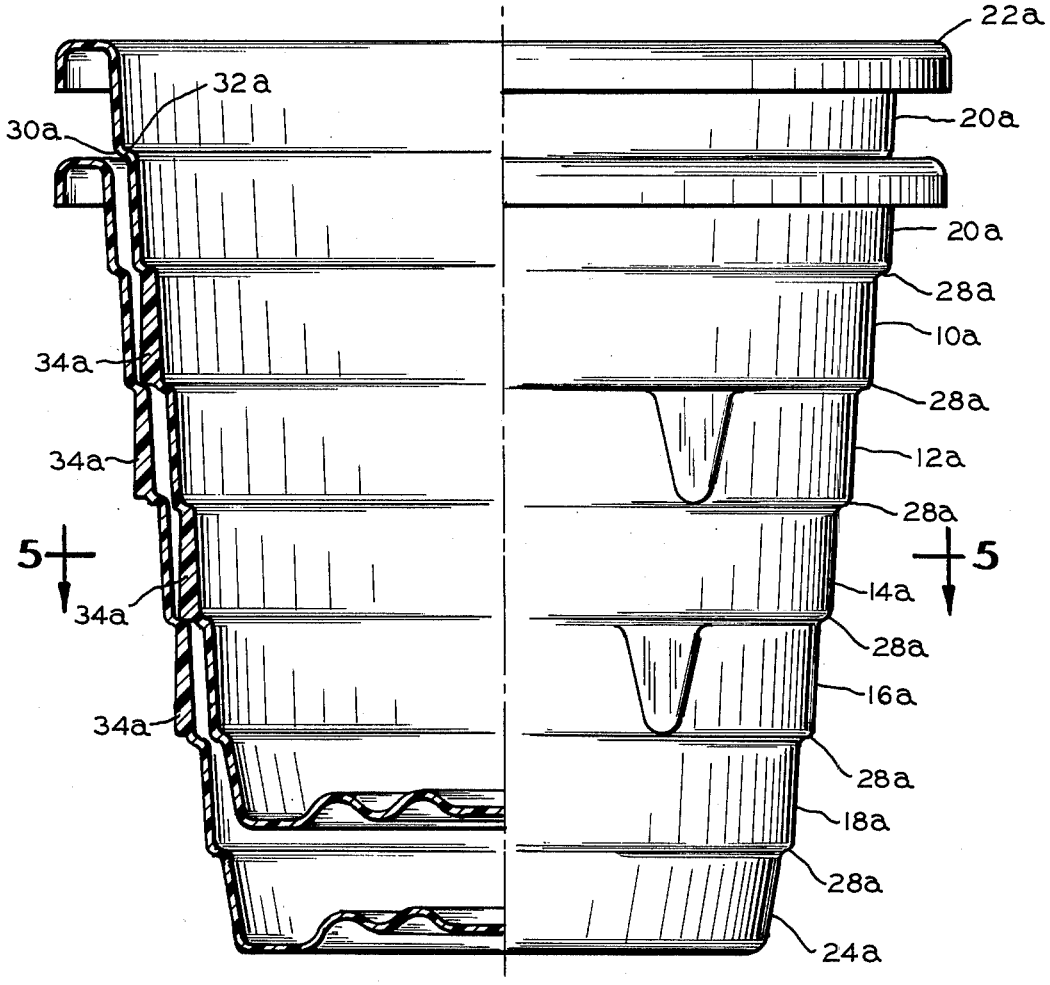
FIG. 4 is a side elevational view, similar to FIG. 3, but showing another embodiment of the invention.
Figure 5:
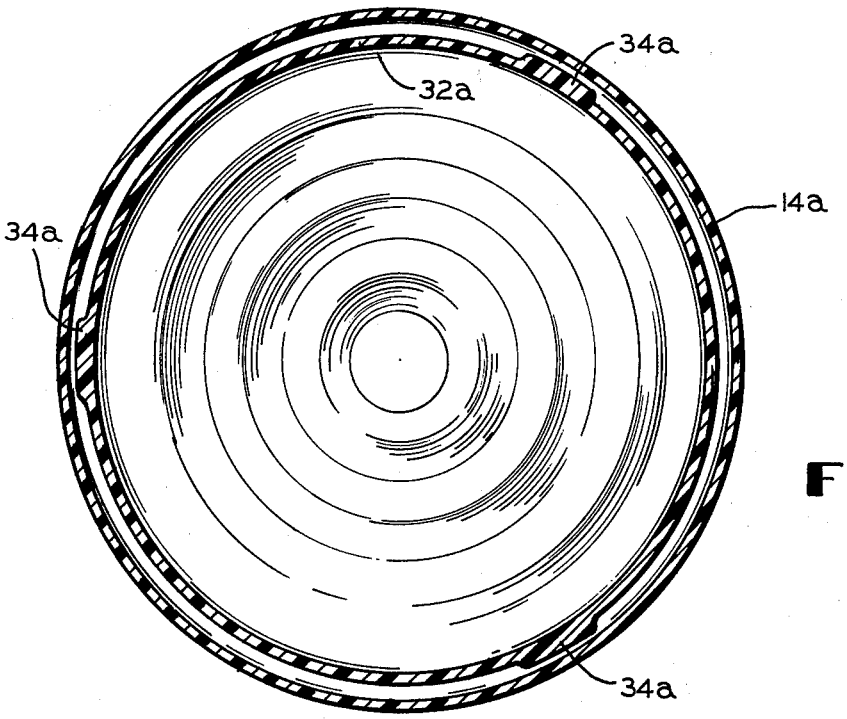
FIG. 5 is a cross-sectional view taken approximately on the line 5—5 of FIG. 4.

The embodiment of hamper shown in FIGS. 4 and 5 is generally similar to that shown in FIGS. 1 through 3, but differs principally therefrom in the positioning of the abutments 34. Those portions of the embodiment shown in FIGS. 4 and 5 which correspond to similar portions of the embodiment shown in FIGS. 1 through 3 are designated by a like reference numeral characterized further in that a suffix "a" is affixed thereto. In the embodiment shown in FIGS. 4 and 5, the triangular abutments 34 are located on the outside of the container with the outside surface of the abutments being generally vertical.

While the invention has been described in considerable detail, I do not wish to be limited to the particular embodiments shown and described; and it is my intention to cover hereby all novel adaptations, modifications and arrangements thereof which come within the practice of those skilled in the art to which the invention relates, and which fall within the purview of the following claims.

I claim:

1. A molded nonlocking nestable vegetable hamper and the like capable of being removed from a one piece internal mold section, and comprising: a generally cup-shaped container having an open top and a closed bottom and sidewalls of a uniform thickness stiff enough to support other similar hampers loaded with vegetables when stacked on its upper edge, said sidewalls being stepped inwardly from top to bottom to provide a plurality of concentric segments separated by identically shaped shoulders having rounded edges, said sidewalls of each segment being tapered inwardly at an angle which causes the bottom outside rounded edge of one segment to nest into a container opposite the top inside rounded edge of the same segment of another one of the hampers, and circumferentially spaced apart stops for engaging one or more of said shoulders and formed by a thickened section of segment sidewall extending between the top and bottom of a segment with its exposed surface being vertical and the side edges of the stops being tapered to release vertically from a one piece internal male mold section, said stops holding said outside and inside rounded edges of said shoulders of nested hampers opposite each other, so that flexing of one hamper over another separates nested hampers.

2. The container of claim 1 wherein said container has a top edge that is turned outwardly and downwardly by less than the height of said uniform segments to form an annual finger tip receiving handle, and with the top of said edge being spaced above the top one of said shoulders by a distance generally corresponding to the height of said uniform segments, said top edge having a rounded inside juncture with the top segment of the said radius as said rounded edges of said shoulders to nest opposite the bottom outside rounded edge of another one of the hampers.

3. The container of claim 2 including at least three circumferentially spaced apart stops arranged to abut the lower outside shoulder of one or more of said segments to hold said shoulders in alignment.

4. The container of claim 2 including at least three circumferentially spaced apart stops on the inside of the bottom one of said segments, said stops being arranged to abut the lower outside shoulder of the lowermost one of said segments to hold said shoulders in alignment.

5. The container of claim 4 wherein said container has a nonuniform segment below the lowermost one of said uniform segments, said nonuniform segment being tapered downwardly and inwardly at a greater angle than said uniform segments.

* * * * *